US005353905A

United States Patent [19]

Yokomori

[11] Patent Number: 5,353,905

[45] Date of Patent: Oct. 11, 1994

[54] COIN SORTING DEVICE

[75] Inventor: Shinji Yokomori, Matsumoto, Japan

[73] Assignee: Fuji Electric Co., Ltd., Kawasaki, Japan

[21] Appl. No.: 845,698

[22] Filed: Mar. 4, 1992

[30] Foreign Application Priority Data

Mar. 4, 1991 [JP] Japan ..... 3-037079

[51] Int. Cl.[5] ..... G07D 5/08

[52] U.S. Cl. ..... 194/317

[58] Field of Search ..... 194/317, 318, 319

[56] References Cited

U.S. PATENT DOCUMENTS 3,918,565 11/1975 Fougere et al. ..... 194/317

FOREIGN PATENT DOCUMENTS 0072189 2/1983 European Pat. Off. ..... 194/317

*Primary Examiner*—F. J. Bartuska

*Attorney, Agent, or Firm*—Brumbaugh, Graves, Donohue & Raymond

[57] ABSTRACT

In a conventional coin sorting device, sensor abnormalities tend to be overlooked as the reference value used to determine whether a coin introduced is good or bad is set by the introduction of a coin with the reference characteristics during an adjustment. In the present invention, a representative value common to a plurality of coin sorting devices of a similar type is used as the reference value. From the detection value and reference value of a coin that has been introduced into the coin sorting device, the constants of a linear regression formula related to both values are obtained and set during an adjustment. When the coins are sorted, the detection value of the coin being sorted is corrected by those constants and compared with the reference value or, in another embodiment, the sensor detection signals for the sorted coins are corrected to a value corresponding to the reference value relating to the linear formula by applying a constant in the second memory when the coins are sorted, and the peak value being derived and is used as the comparative detection value. Furthermore, a sensor abnormality can be identified by checking the aforementioned constants.

7 Claims, 3 Drawing Sheets

COIN SORTING DEVICE

BACKGROUND OF THE INVENTION

The present invention relates to a coin sorting device which can be mounted in an automatic vending machine and which is capable of facilitating detection of a sensor abnormality and of shortening the adjustment time.

FIG. 6 schematically illustrates the construction of an electronic coin sorting device. As shown in the figure, when a coin 1 is introduced, the coin 1 rolls down a coin path 2 and is assessed as either good or bad, and has its denomination read by the coil sensor which is disposed on the coin path 2. The coin that is assessed as good is led to a good coin path 5A as a gate 4 is pulled. If the coin is assessed as bad, the coin is led to a bad coin path 5B as the gate 4 is not pulled.

FIG. 7 is a construction diagram depicting the principles of the detection circuit 11 used to detect a change in the impedance of the coil sensor when the coin 1 passes the coil sensor 3; comprising a bridge circuit consisting of the coil sensor 3, resistors 6A and 6B, a capacitor 7, and an oscillator 8. The output of this bridge circuit is supplied to a rectification circuit 10 through a differential amplification circuit 9. When the coin 1 is introduced into the coin sorting device, the output 11*a* of the detection circuit 11 changes with the characteristics of the coin 1 as shown in FIG. 8 (1A through 1C).

FIG. 5 is a block diagram of a circuit for making adjustments and determinations in a conventional coin sorting device. With this system, when the coin sorting device is adjusted, the analog output value 11*a* that is derived from the detection circuit 11 in FIG. 7 as a result of introducing a coin with a reference characteristic, is converted into a digital value "x(t)" by means of an A/D converter 12. Furthermore, a peak value "x" is obtained from this digitally converted output "x(t)" by means of the peak detector 13, and this peak value is then adopted as a characteristic value. This characteristic value is stored in the memory 14 as the reference value for a denomination.

Next, when the coin sorting device is actually used to sort coins, the characteristic value of the introduced coin is compared, using a comparator 15, with the reference value stored in the memory 14, and if the difference between these two values is within a permissible range, the coin will be determined, by a determination circuit 16 to be a good coin of the denomination corresponding to the reference value.

In the above-mentioned conventional coin sorting device, the reference value stored in the memory 14 is the characteristic value of a coin introduced during an adjustment. When the coil sensor 3 suffers from any abnormality, the characteristic value detected by this abnormal sensor will be used as the reference value; and it will be impossible to detect any abnormality in the coil sensor 3.

The present invention is aimed at providing a coin sorting device capable of facilitating detection and/or compensation of a sensor abnormality and of shortening the adjustment time.

SUMMARY OF THE INVENTION

To detect and/or compensate for sensor abnormalities, a coin sorting device includes processing and memory means for applying a linear function or regression to a sensor signal. A desired peak value may be obtained either by first finding the peak value of sensor signals and then applying the linear function, or else by applying the linear function to sensor signals and then finding the peak value of the transformed signals. Linear regression coefficients or constants can be found in a calibration step prior to use of the device for sorting.

BRIEF DESCRIPTION OF THE DRAWINGS

For convenience of reference, like components, elements, and features in the various figures are designated by the same reference numerals or characters.

DETAILED DESCRIPTION OF PREFERRED EMBODIMENTS

Figure 1:
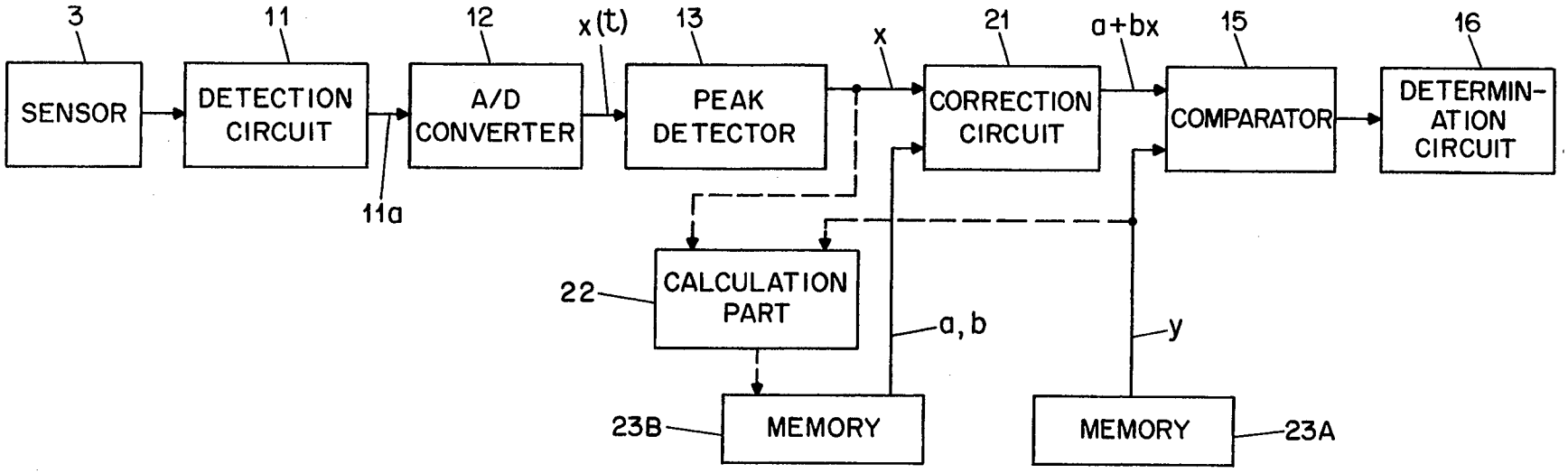
FIG. 1 is a block diagram showing the essential structure of one embodiment of the present invention.

According to the present invention, in one preferred embodiment, the coin sorting device is arranged so that a sensor (coil sensor 3, for example) is disposed on a coin path 2; wherein a comparative detection value is derived from a detection signal produced by the sensor after a coin that is placed in the device and which passes the coin path is compared with a reference value that is based upon a denomination of coins initially set in a first memory; wherein the coin that is placed in the device is determined to be a specie of a denomination when the comparative detection value is within a predetermined range relative to one of the reference values. The reference values to be used are values con, non to a plurality of coin sorting devices of a similar type as the said coin sorting device and there is a calculation means disposed, by which a constant (also known as a correction coefficient constant) for a linear regression formula is derived; the constant to represent an approximate relation between a peak value of the sensor detection signals, derived from introducing one or more types of true coins into the coin sorting device, and the reference values corresponding to the denominations of the coins initially set in the first memory. The constant (correction coefficient constant) is to be stored in a second memory when an adjustment is made.

In this embodiment, the peak value of the sensor detection signals for the sorted coins is corrected to a value corresponding to the reference value relating to the linear regression formula by using the constants (correction coefficient constants) stored in the second memory, with the corrected value to be used as the comparative detection value when the coins are sorted.

In another embodiment, the coin sorting device is arranged so that the coil sensor 3 is disposed on the coin path 2; wherein a comparative detection value is derived from a detection signal produced by the sensor after a coin that is placed in the device and which passes the coin path is compared with a reference value that is based upon a denomination of coins initially set in a first memory; wherein the coin that is placed in the device is determined to be a specie of a denomination when the comparative detection value is within a predetermined range relative to one of the reference values. The reference values to be used are values common to a plurality of coin sorting devices of a similar type as the said coin sorting device and there is a calculation means disposed, by which a constant (also known as a correction coefficient constant) for a linear regression formula is derived; the constant to represent an approximate relation between a peak value of the sensor detection signals, derived from introducing one or more types of true coins into the coin sorting device, and the reference values corresponding to the denominations of the coins initially set in the first memory. The constant (correction coefficient constant) is to be stored in a second memory when an adjustment is made.

In this embodiment, the sensor detection signals for the sorted coins are corrected to a value corresponding to the reference value relating to the linear regression formula by applying constants (correction coefficient constants) stored in the second memory when the coins are sorted, and the peak value of the corrected value being derived and used as the comparative detection value.

As a result, in the present invention, an abnormality in the sensor during an adjustment can be detected by checking whether the constants (correction coefficient constants) are abnormal.

Preferred embodiments of the present invention are explained with reference to FIGS. 1 through 4. FIG. 1 is a block diagram showing one embodiment of the circuit, according to the present invention, representing an improvement over the conventional coin sorting device corresponding to FIG. 5. In reference to FIG. 1, after the coin sorting device has been adjusted the characteristic value "x" derived from the output value 11*a* of the peak detector 13 as a result of a coin passing through the A/D converter 12 and the peak detector 13, is measured as x1, x2, . . . , xn (for n denominations).

The memory 23*a* has, already contained within, the representative reference values y=y1, y2, . . . , yn used to indicate certain denominations. These values have been obtained previously, through experimentation, as the reference values representing many coin sorting devices of the same model.

The calculation part 22 calculates the coefficients "a" and "b" , suitable for the linear regression formula y=a+bx; with the representative reference value y=y1, y2, . . . , yn and the measured characteristic value (e.g. the output of the peak detector (13)) x=x1, x2, . . . , xn. For example, the values of "a" and "b" are obtained using the so-called least-square method as the minimum value of:

$$\sum_{i=1}^{n} (y_i - a - bx_i)^2,$$

$$b = \sum_{i=1}^{n} (x_i - x_m)(y_i - y_m) / \sum_{i=1}^{n} (x_i - x_m)^2$$

$$a = y_m - bx_m$$

(where xm, ym are the mean values of the x's and y's, respectively)

Figure 3:
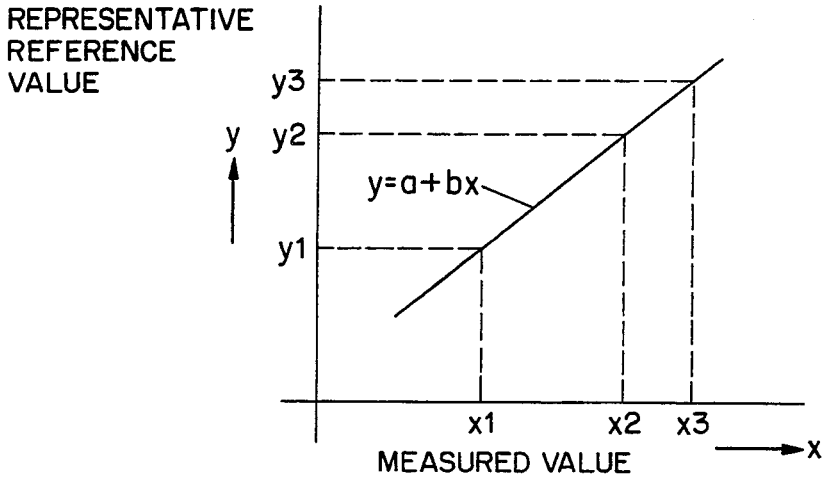
FIG. 3 is a diagram showing a linear regression formula of one embodiment of the present invention.

FIG. 3 shows an example of the relation of the representative reference values y=y1, y2, y3 and the measured value x=x1, x2, x3; with the linear regression formula y=a+bx to be derived from both values. Using this relation, calculations may, of course, be done with the high denominations weighted. The values "a" and "b" are stored in the memory 23*b*, as indicated in FIG. 1, as the correction coefficients.

Next, according to the present invention as referenced in FIG. 1, when this coin sorting device is actually used to sort coins, the characteristic value "x", which is the output of the peak detector 13 resulting from the introduction of a coin to be sorted, is corrected to a+bx by the correction circuit 21 using the correction coefficients "a" and "b" which are stored in the memory 23*b*. This resulting corrected value is then compared, by the comparator 15 referenced in FIG. 1, to the reference values referring to the denominations of y1, y2, . . . , yn contained in the memory 23*b* that is storing a+bx, and if the corrected value is within the permissible range of any of the reference values y1, y2, . . . , yn, the coin is determined by the determination circuit 16 to be a coin of a denomination equivalent to this reference value.

Figure 2:
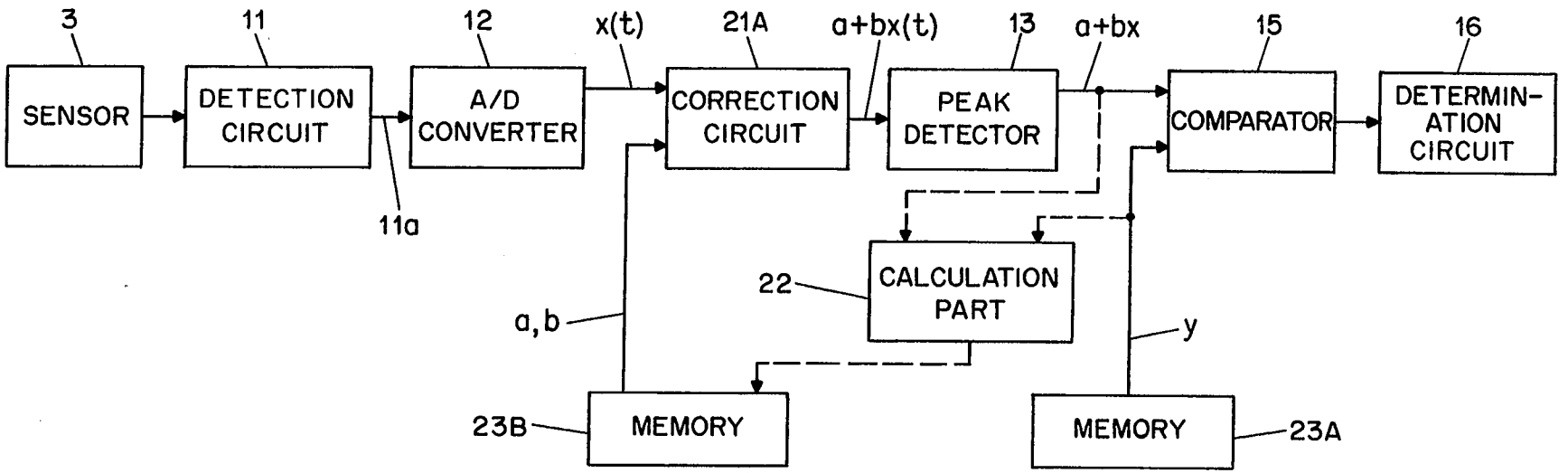
FIG. 2 is a block diagram showing a modified form of the embodiment shown in FIG. 1.

FIG. 2 is a block diagram of an embodiment different from that in FIG. 1. The operation shown in FIG. 2 is identical to the operation as indicated in the embodiment in FIG. 1 when the coin sorting device is being adjusted, but differs when the coin sorting device is actually used for coin sorting. In coin sorting, the output value "x(t)" of the A/D converter 12 is input into the correction circuit 21*a* and corrected to a+bx (t), with the peak value a+bx obtained by the peak detector 13. This peak value a+bx is then compared with the representative reference value y1, y2, . . . , yn stored in the memory 23*a* by the comparator 15, and the results of this comparison are determined by the determination circuit 16.

As another embodiment of the method to adjust the coin sorting device, when the correction coefficients "a" and "b" are obtained as a function of the output value "xo" of the peak detector 13, when no coin is present in the coil sensor 3, and the characteristic value "xi" (output by the peak detector 13) of a particular denomination "i", with "yo and yi" as the representative reference values corresponding to the values "xo and xi" then an adjustment can be carried out by the introduction of just one coin of a single denomination. As a result, the adjustment of the coin sorting device can be simplified.

Figure 4:
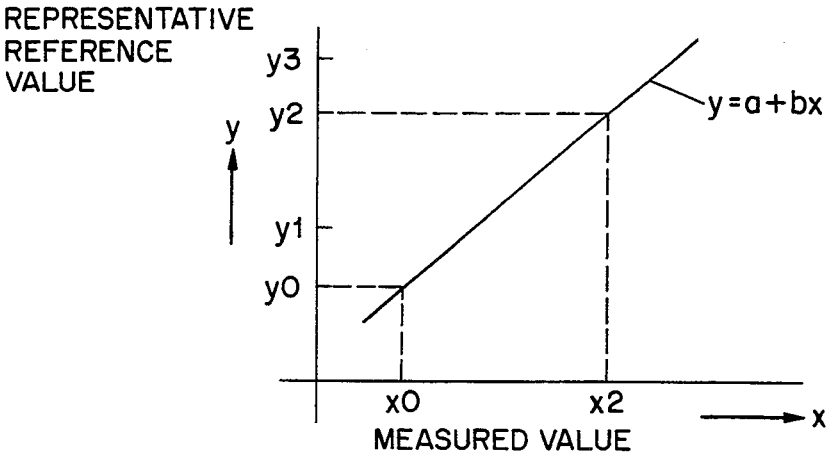
FIG. 4 is a diagram showing a linear regression formula of another embodiment of the present invention.
Figure 5:
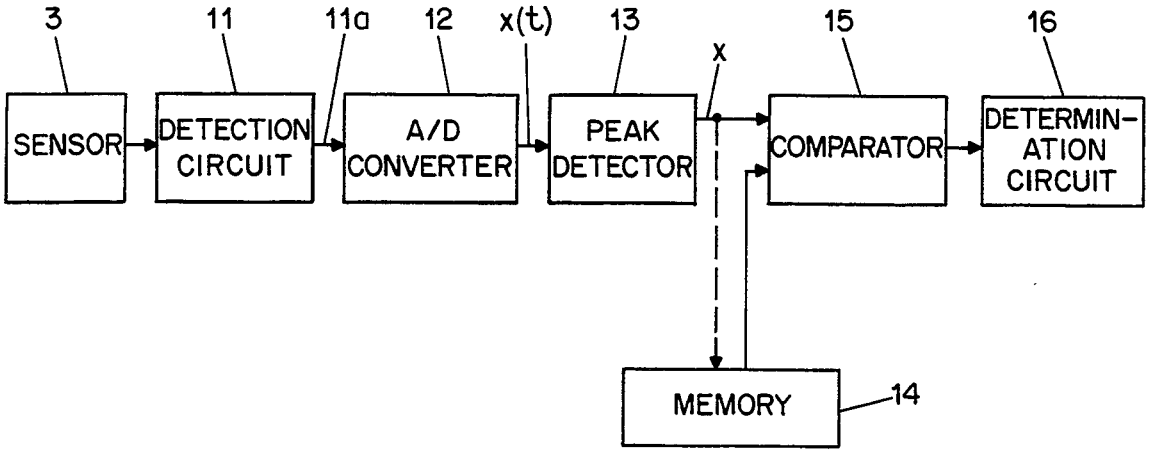
FIG. 5 PRIOR ART
FIG. 5 is a block diagram for a conventional circuit in an electronic coin sorting device.
Figure 6:
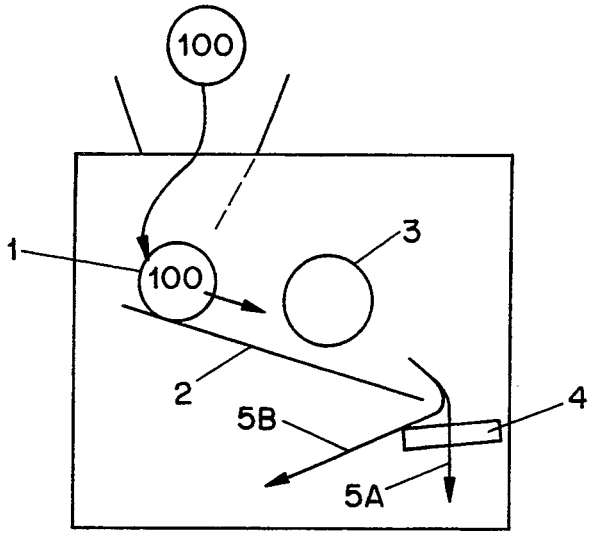
FIG. 6 PRIOR ART
FIG. 6 schematically shows the structure of a sorting mechanism used in an electronic coin sorting device.
Figure 7:
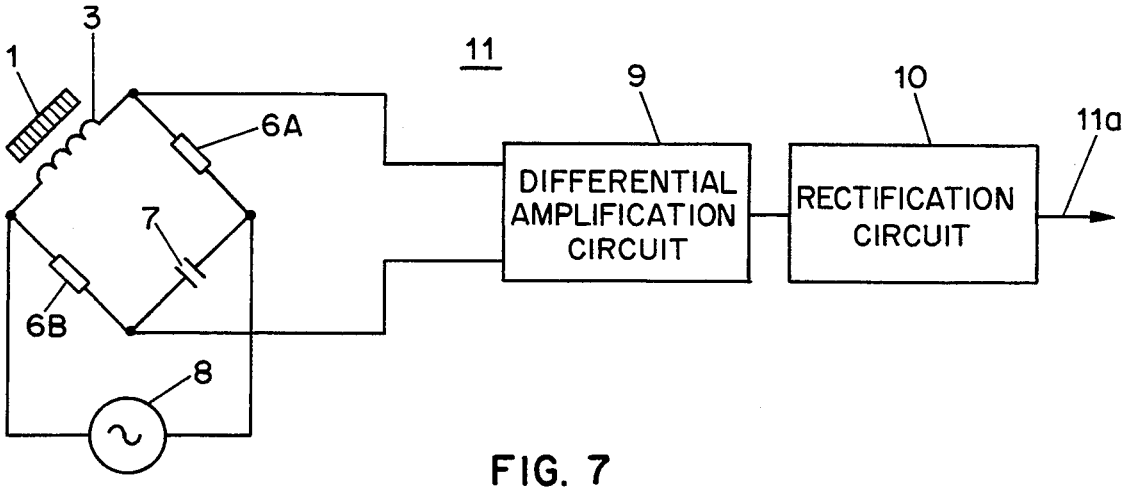
FIG. 7 PRIOR ART
FIG. 7 is a construction diagram depicting the principles of a detection circuit.
Figure 8:
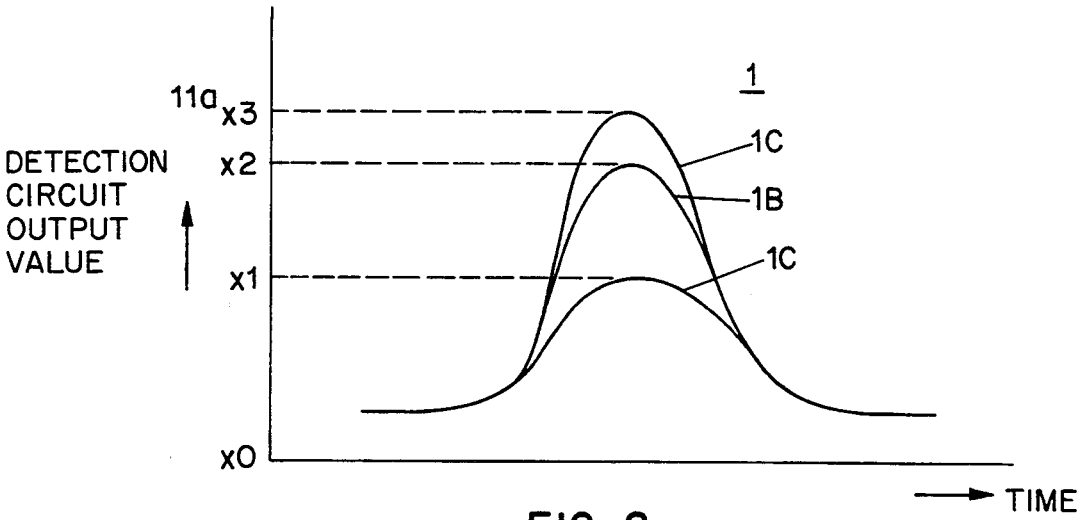
FIG. 8 PRIOR ART
FIG. 8 is a graphical representation illustrating an example of output waveforms in a detection circuit.

FIG. 4 is a graph showing the relation of the representative reference values "yo, yi" under the above conditions and the measured values "xo xi" (with i=2 in this example) with the linear regression formula y=a+bx to be determined therefrom.

I claim:

1. A coin sorting device comprising:

a coin path;

a sensor on the coin path for producing a time-dependent, quantitative sensor-output signal in response to a coin traversing the coin path, the sensor-output signal here being designated as x(t);

processing means connected to the sensor, for processing the sensor-output signal, comprising peak detector means for determining the peak value of x(t);

first memory means connected to the processing means, for storing at least three reference values, here designated as $y_1, y_2, \ldots, y_n$, $n \geqq 3$;

second memory means connected to the processing means, for storing linear-regression coefficient values, here designated as a and b;

wherein the processing means further comprises:

calibration means for producing the linear regression coefficient values such that, for peak values $x_1, x_2, \ldots, x_n$ corresponding to n coins, the sum, from $i=1$ to n, of $(y_i - a - bx_i)^2$ is minimized; and validation means for producing a signal, here designated as $y_{max}$, which at least approximately represents the peak value of $a \cdot x(t) + b$, and for comparing $y_{max}$ with at least one of the reference values.

2. The device of claim 1, wherein the validation means is adapted for determining the peak value of x(t), here called $x_{max}$, and for producing $y_{max}$ as $a \cdot x_{max} + b$.

3. The device of claim 1, wherein the validation means is adapted for producing $y(t) = a \cdot x(t) + b$, and for producing $y_{max}$ as the peak value of y(t).

4. The device of claim 1, wherein the first memory means is adapted for storing a plurality of reference values, and wherein the validation means is adapted for comparing $y_{max}$ with each one of the plurality of reference values.

5. The device of claim 1, wherein the calibration means is adapted for determining the values a and b from sensor signals and corresponding reference values.

6. The device of claim 5, wherein the calibration means is adapted for determining the values a and b from sensor signals and corresponding reference values for a plurality of coins having different denominations.

7. The device of claim 5, wherein the calibration means is adapted for determining the values a and b from a first sensor signal obtained in the absence of a coin passing the sensor, a second sensor signal obtained as a coin passes the sensor, and a reference value corresponding to the denomination of the coin.

* * * * *